United States Patent [19]

Smithies et al.

[11] Patent Number: 4,796,531

[45] Date of Patent: Jan. 10, 1989

[54] MINING METHOD

[75] Inventors: Stafford A. Smithies; Raymond C. Atkins, both of Pretoria, South Africa

[73] Assignee: Gernal Mining Union Corporation Limited, Johannesburg, South Africa

[21] Appl. No.: 69,210

[22] Filed: Jul. 1, 1987

[30] Foreign Application Priority Data

Jul. 4, 1986 [ZA] South Africa ..... 86/4984

[51] Int. Cl.[4] ..... F42B 3/10

[52] U.S. Cl. ..... 102/217; 102/206

[58] Field of Search ..... 102/200, 206, 217

[56] References Cited

U.S. PATENT DOCUMENTS

| | | | |
|---|---|---|---|
| 2,891,476 | 6/1959 | Forsyth | 102/275.3 |
| 3,099,962 | 8/1963 | Smith | 102/217 |
| 3,316,451 | 4/1967 | Silberman | 361/249 |
| 3,420,175 | 1/1969 | Swallow et al. | 102/217 |
| 3,513,355 | 5/1970 | Shauks | 361/249 |
| 3,714,895 | 2/1973 | Rawson | 376/273 |
| 3,808,459 | 4/1974 | Guimier et al. | 102/217 |
| 3,987,733 | 10/1976 | Spraggs et al. | 102/275.4 |
| 4,099,467 | 7/1978 | Mackellar et al. | 102/217 |
| 4,326,752 | 4/1982 | Ricketts | 102/312 |
| 4,350,097 | 9/1982 | Bowman et al. | 102/275.2 |
| 4,406,226 | 9/1983 | Davitt et al. | 102/311 |
| 4,493,259 | 1/1985 | Munzel | 102/206 |
| 4,536,693 | 8/1985 | Marek | 102/218 |

FOREIGN PATENT DOCUMENTS

| | | | |
|---|---|---|---|
| 0136919 | 4/1985 | European Pat. Off. . | |
| 8368 | 6/1973 | South Africa | 102/217 |

*Primary Examiner*—Charles T. Jordan
*Assistant Examiner*—Michael J. Carone
*Attorney, Agent, or Firm*—Armstrong, Nikaido, Marmelstein & Kubovcik

[57] ABSTRACT

System for the electrical sequential initiation of explosions comprising a series of initiating modules connected to one another and connectable to a power supply, and a corresponding series of electrically actuable initiators. Each initiating module is connected to an initiator and embodies a non-latching switch for actuating the initiator associated with that initiating module. The non-latching switch comprises a solid state electronic device having an emitter, a gate and a collector, and comprises a short circuit between the gate and the emitter for holding the device in an "off" state to a voltage applied to the collector. The device also comprises an open circuit between the gate and the emitter for turning the device "on" to a voltage applied to the collector, while a diode integrated on the device blocks a reverse supply voltage. The non-latching switch of each initiating module save the first in the series is connected to the initiator associated with the preceding initiating module in the series. The arrangement is such that, in operation of the system, the non-latching switch of each initiating module is disabled until the initiator associated with the preceding initiating module in the series has been actuated by that initiating module. The initiating modules in the series are actuable sequentially by the power supply so as to sequentially initiate the series of initiators.

7 Claims, 5 Drawing Sheets

MINING METHOD

BACKGROUND TO THE INVENTION

This invention relates to a mining method and more particularly to the electrical sequential initiation of explosions in mining operations. The invention also concerns initiating means for use in such a system.

The accurate sequencing of explosions in underground mining operations is of the utmost importance. In advancing a tunnel or stope, sequential blasting is used to ensure that rock is moved in the required direction and to achieve efficient "chiselling" of the rock mass. Both out-of-sequence blasts and misfires can accordingly have significant adverse effects on mining production.

In an electrical sequential initiation system, initiating means may be used to initiate delay elements sequentially according to the sequence of explosions required. Once the delay element has performed its delay function, the explosive charge with which it is associated is detonated.

There is no technical barrier to providing an electrical sequential initiation system of this kind. However, in the mining industry such a system will only be viable if it can be produced at low cost.

It is accordingly an object of the invention to provide an electrical sequential initiation system which is of relatively simple configuration and which can be produced at relatively low cost.

SUMMARY OF THE INVENTION

A system according to the invention for the electrical sequential initiation of explosions comprises a series of initiating modules connected to one another and adapted to be powered by a power supply, and, a corresponding series of electrically actuable initiators, each module being connected to an initiator, each module comprising non-latching switching means actuable to actuate the initiator associated with that module, the switching means of each module save the first in the series being connected to the initiator associated with the preceding module in the series, the arrangement being such that in operation of the system the switching means of each module are disabled until the initiator associated with the preceding module in the series has been actuated by that module, the modules in the series being adapted sequentially to be actuated by the power supply so as sequentially to initiate the series of initiators.

The non-latching switching means preferably comprise a solid state electronic device having an emitter, a gate and a collector, the device being characterised in that a short circuit between the gate and the emitter holds the device in an "off" state to a voltage applied to the collector and in that an open circuit between the gate and the emitter turns the device "on" to a voltage applied to the collector, whilst a diode integrated on the device blocks a reverse applied voltage. In a preferred form the device embodies a Darlington transistor arrangement.

In a preferred configuration the initiating modules are connected to the power supply and to one another by a pair of trunk lines which cross over in adjacent modules in the series. This configuration enables all the initiating modules to be identical and obviates the need for grouping of the modules in pairs. With this configuration the power supply may be in the form of a shot initiator which reverses the polarity of the supply voltage to the modules at a predetermined rate to cause actuation of the series of initiators at the same rate.

Each initiator may comprise a fusible link, for example an aluminium or zirconium link, which is rendered an open circuit when fused.

The invention also extends to an initiating module for use in a system for the electrical sequential initiation of explosions, as hereinabove defined.

BRIEF DESCRIPTION OF THE DRAWINGS

A preferred embodiment of the invention will now be described by way of example with reference to the accompanying drawings in which.

DESCRIPTION OF PREFERRED EMBODIMENT

Figure 1:
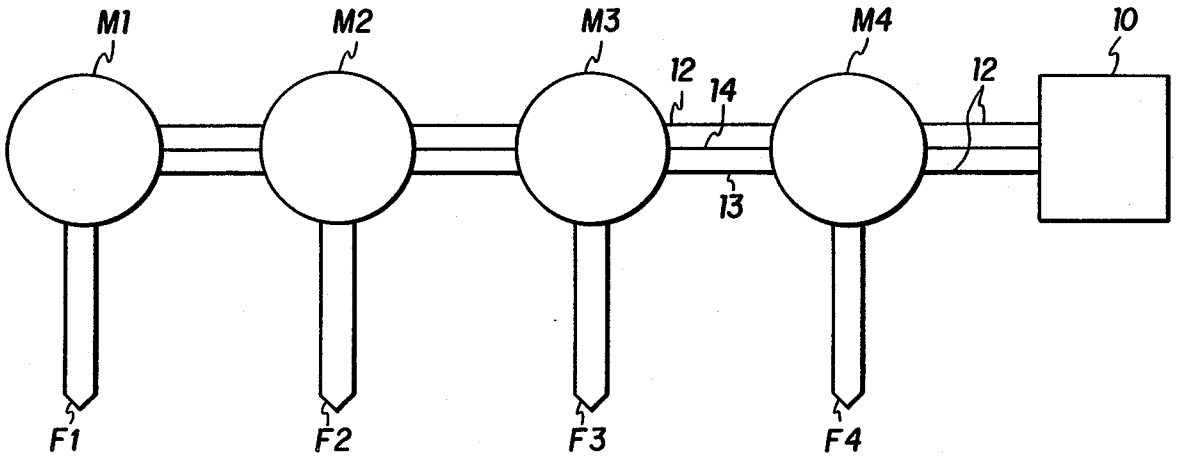
FIG. 1 is a block-type diagram of an electrical sequential initiation system arranged in accordance with the invention.
Figure 2:
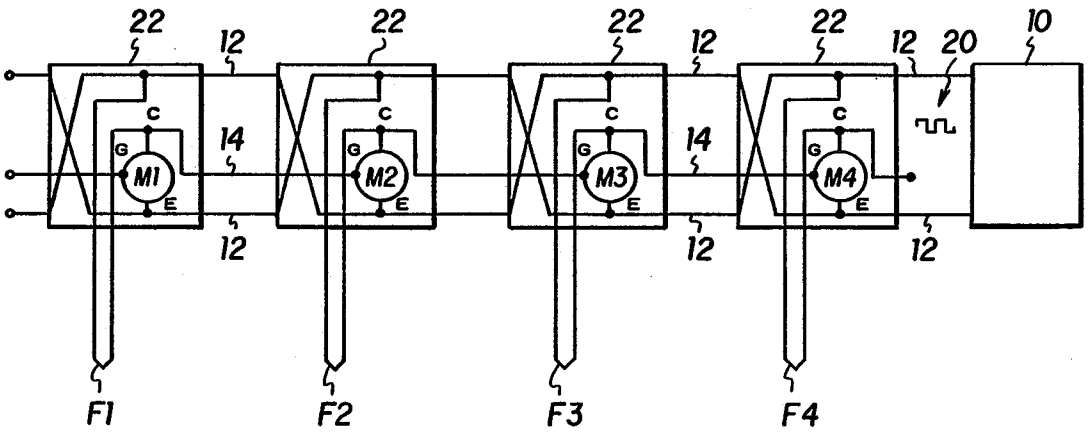
FIG. 2 is a similar diagram illustrating electrical connections of the system.

FIGS. 1 and 2 illustrate a four stage electrical sequential initiation system arranged in accordance with the invention. The system comprises a series of four initiating modules designated M1 to M4 and a corresponding series of four initiators designated F1 to F4. The system is powered by a shot initiator 10 which is connected by two trunk wires 12 to the last initiating module M4. The initiating modules M1 to M4 are connected to one another by the two trunk wires 12 and by a third "sense" wire 14, the function of which will be more fully described hereunder. Each of the initiators F1 to F4 may comprise a fusible link, for example, an aluminium or zirconium link which is rendered an open circuit when it is fused by an electrical current.

Figure 3:
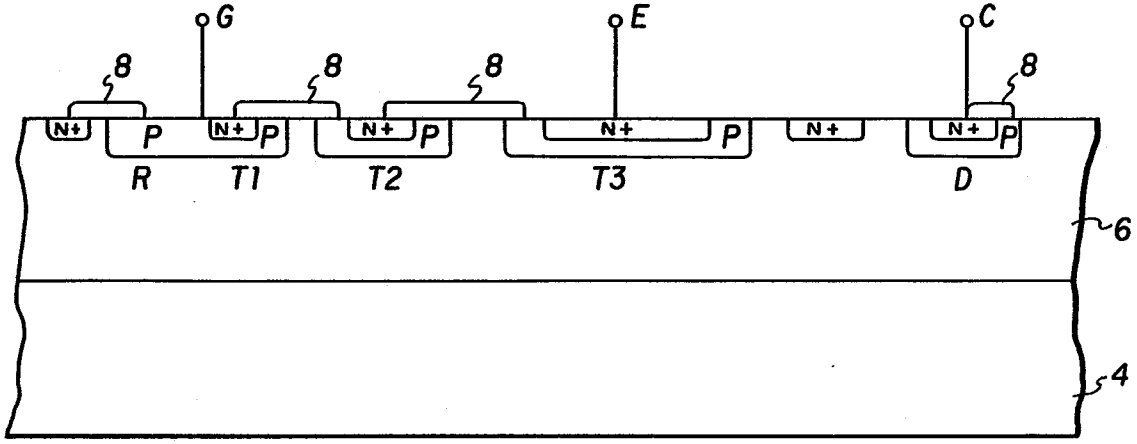
FIG. 3 is a diagrammatic representation of a section through a solid state initiating module used in the system.
Figure 4:
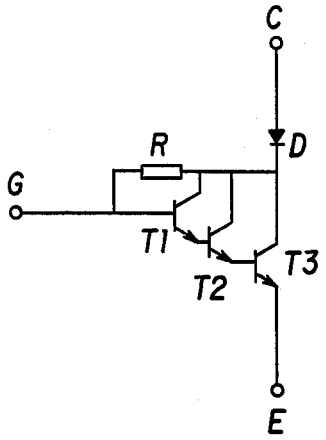
FIG. 4 is an equivalent circuit of the initiating module.

Each initiating module M1 to M4 comprises a solid state electronic non-latching switch device illustrated in FIGS. 3 and 4 and which has an emitter, gate and collector accessible via terminals E, G and C respectively. The module is composed of a Darlington transistor arrangement T1 to T3 having a diode D between the collector of transistor T3 and the collector terminal C of the module. Resistor R is provided between the collector of transistor T3 and the gate of transistor T1.

Figure 5:
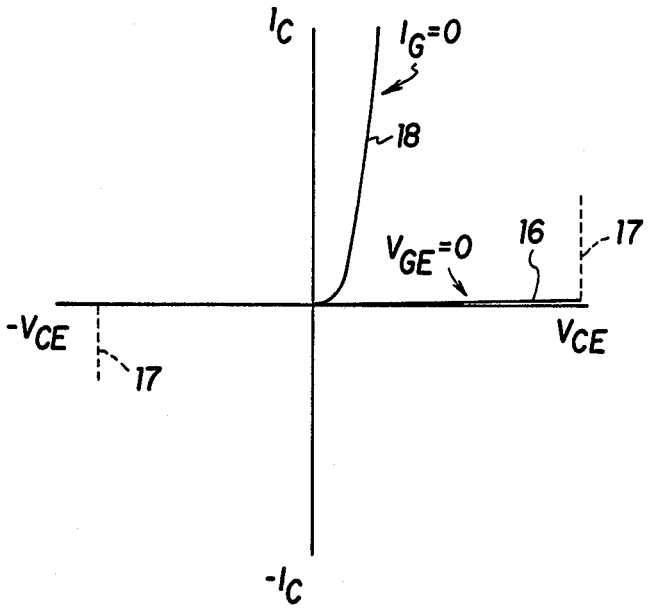
FIG. 5 is a graph illustrating the electrical characteristics of the module.

The construction of the integrated module is illustrated in FIG. 3 from which it can be seen that it comprises a lateral four-layer structure having an N+ silicon substrate 4 with an N epitaxy layer 6 thereon. Interconnecting metal on the device is designated by the reference numeral 8. The characteristics of the module are illustrated in FIG. 5. Of particular importance is the fact that the module is used in two modes, that is a blocking mode represented by curve 16 and a conducting mode represented by curve 18. Referring firstly to the blocking mode, when the gate G and emitter E of a module M are shorted, that is when VGE=0, the transistors T1 to T3 are held in an "off" state to a positive voltage applied to the collector C, whilst the diode D blocks reverse voltages. The only current flowing through the module in this mode is approximately VCE/R. The value of R is chosen so that the current through the module is negligible from the point of view of operation of the initiation system. The forward and reverse breakdown characteristics are indicated by numeral 17.

Figure 6:
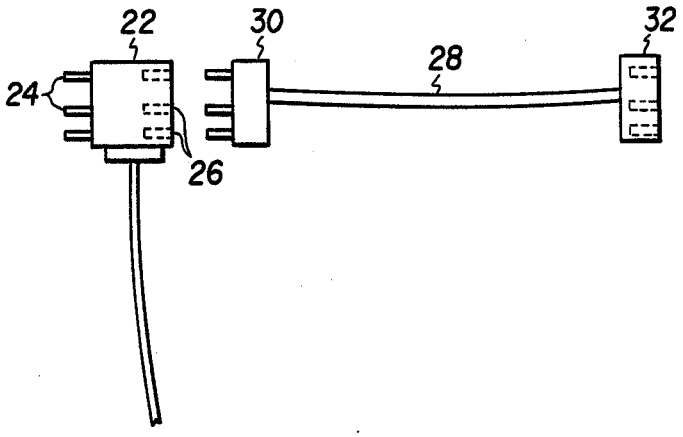
FIG. 6 shows a connector used in the system of FIGS. 1 and 2.

When the gate G is an open circuit, that is when IG=0, a positive applied collector voltage will cause the resistor R to pull the transistor T1 on and hence all the transistors T1 to T3 will conduct. Curve 18 in FIG. 5 illustrates the current flow through the module. The forward voltage drop will be the saturation voltage of the transistors T1 to T3 plus the forward drop across the diode D. For a negative collector voltage, the diode D continues to block current flow. A further important feature of the module is the cross-over of the trunk lines 12 in the circuitry of the module itself as shown in FIG. 2. The moduels are hence identical and this obviates the need for their grouping in pairs. In practice, each of the moduels M1 to M4 will be encapsulated in a connector which is schematically illustrated by numeral 22 in FIG. 2 and which is shown in FIG. 6. Each connector has three prongs 24 on one side and three corresponding sockets 26 on an opposite side. The prongs and sockets will connect to the emitter, gate and collector of each module according to the configuration of FIG. 2. Adjacent modules are connected by lengths of electrical cable 28 terminating in elements 30, 32 having prongs and sockets corresponding with those of the connectors 22 and carrying the trunk wires 12 and the sense wire 14.

The above described modules are interconnected in the electrical sequential initiation system shown in FIGS. 1 and 2. As seen from FIG. 2, the gates G of the modules M2 to M4 are connected by means of the sense wires 14 to the initiators F1 to F3 respectively. Thus, the gate of each module save that of the first module is connected to the initiator of the immediately preceding module. The trunk lines 12 connect to the emitter and collector of each module M1 to M4 but as described above the trunk lines cross over between succeeding modules so that they connect alternately to the emitters and collectors of successive modules.

In use, the shot initiator 10 reverses the polarity of the supply voltage to the initiation system at a predetermined rate to cause actuation of the initiators F1 to F4 at the same rate. The wave form of the supply voltage is illustrated by numeral 20 in FIG. 2. With the terminal of the gate G of the first module M1 open and with power applied from the shot initiator 10, there is no gate current to the module M1, that is IG=0. When the voltage becomes positive on the collector C of the module M1, current will pass through the initiator F1. All the remaining modules are in a blocked state. When the initiator F1 fuses it becomes an open circuit. The gate G of the second module M2 immediately becomes reverse biassed as module M1 is conducting but as the collector C of module M2 is negative, it remains in a blocking mode with no current passing through the initiator F2. When the supply voltage reverses, the first module M1 enters the blocking mode and no current flows out of or into the gate G of the second module M2 since the initiator F1 is open. With a positive voltage on the collector C of module M2, current flows through the initiator F2 and it in turn is initiated, becoming an open circuit. When the initiator F2 fuses, the gate G of the module M3 immediately becomes reverse biassed as module M2 is conducting and as the collector C of module M3 is negative it remains in a blocking mode.

In this way the initiators F1 to F4 are sequentially actuated at the rate that the shot initiator 10 reverses the polarity of the supply voltage.

Each of the initiators F1 to F4 may serve to initiate a detonator or a delay element for a detonator, for example, an electronic delay element or a burning fuse. The delay element in turn will serve to initiate an explosion once it has performed its delay function.

The supply voltage from the shot initiator 10 will be limited to a value which is less than the forward and reverse breakdown voltages of the modules M1 to M4 and in addition the current from the initiator 10 will be limited to a predetermined value, being set high enough to ensure that individual initiators F1 to F4 are actuated over a well controlled but short period.

A significant feature of the modules is that they provide a non-latching switch and that the module will return to its blocking mode after non-destructive transient overvoltages provided the preceding initiator F remains intact. This gives the system high immunity to induced spikes and noise on the trunk lines 12. It is also noteworthy that only voltages exceeding the module breakdown voltage will enable current to pass into the initiators and this for only that instant of time that the breakdown voltages of the modules are exceeded. It is important to note, however, that the net energy from the power supply passing into the initiators in these conditions can be strictly limited. In this regard, it has been shown that with the use of prior art silicon controlled rectifier devices (SCRs) as switches in electrical sequential initiation systems, relatively small fast rise time signals can cause spontaneous initiator actuation by a process of dv/dt firing of the SCR. After a SCR has been turned on in this manner, current from the power supply holds the SCR in the on state and energy from the power supply will continue to be applied to the initiators. With these prior art devices this may cause the spontaneous and simultaneous firing of several initiators and may cause out-of-sequence firing.

Many other embodiments of the invention may be made differing in matters of detail only from that described above and without departing from the scope of the invention as defined in the appended claims.

We claim:

1. A system for the electrical sequential initiation of explosions comprising:

a series of initiating modules connected to one another and connectable to a power supply;

a corresponding series of electrically actuable initiators;

each initiating module being connected to an initiator and embodying non-latching switching means for actuating the initiator associated with that initiating module;

the non-latching switching means comprising a solid state electronic device having an emitter, a gate and a collector, the device comprising a short circuit between the gate and the emitter for holding the device in an "off" state to a voltage applied to the collector and an open circuit between the gate and the emitter for turning the device "on" to a voltage applied to the collector, whilst a diode integrated on the device blocks a reverse applied voltage;

the switching means of each initiating module save the first in the series being connected to the initiator associated with the preceding initiating module in the series, the arrangement being such that in operation of the system the switching means of each initiating module are disabled until the initiator associated with the preceding initiating module in the series has been actuated by that initiating module, the initiating modules in the series being actuable sequentially by the power supply so as sequentially to initiate the series of initiators.

2. A system as claimed in claim 1 in which the solid state electronic device embodies a Darlington transistor arrangement.

3. A system as claimed in claim 1 in which the initiating modules are connected to the power supply and to one another by a pair of trunk lines which cross over in adjacent initiating modules in the series, the power supply being in the form of a shot initiator which reverses the polarity of the supply voltage to the initiating modules at a predetermined rate to cause initiation of the series of initiators at the same rate.

4. A system as claimed in claim 3 in which each initiating module is encapsulated in a connector, adjacent connectors being connected by lengths of cable carrying the trunk lines.

5. A system as claimed in claim 1 in which each initiator comprises a fusible link which is rendered an open circuit when fused.

6. an initiating module suitable for use in a system for the electrical sequential initiation of explosions comprising a solid state electronic device having an emitter, a gate and a collector, the device comprising a short circuit between the gate and the emitter for holding the device in an "off" state to a voltage applied to the collector and an open circuit between the gate and the emitter for turning the device on to a voltage applied to the collector, whilst a diode intergrated on the device blocks a reverse applied voltage.

7. A module as claimed in claim 6 in which the module embodies a Darlington transistor arrangement.

* * * * *